US007052109B2

(12) United States Patent
Unosawa

(10) Patent No.: US 7,052,109 B2
(45) Date of Patent: May 30, 2006

(54) INK JET RECORDING APPARATUS

(75) Inventor: Yasuhiro Unosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 10/671,968

(22) Filed: Sep. 25, 2003

(65) Prior Publication Data

US 2004/0061738 A1 Apr. 1, 2004

(30) Foreign Application Priority Data

Sep. 26, 2002 (JP) ..... 2002-281298

(51) Int. Cl.
*B41J 2/165* (2006.01)

(52) U.S. Cl. ..... 347/34; 347/23

(58) Field of Classification Search ..... 347/22, 347/23, 29–34
See application file for complete search history.

(56) References Cited

U.S. PATENT DOCUMENTS 4,369,450 A * 1/1983 Iwagami et al. ..... 347/34
6,017,111 A * 1/2000 Kurata ..... 347/34

* cited by examiner

*Primary Examiner*—Shih-Wen Hsieh
(74) *Attorney, Agent, or Firm*—Morgan & Finnegan, LLP

(57) ABSTRACT

A recording head cartridge is mounted on a carriage scanning in a forward direction and in a backward direction along the width direction of a recording medium. The fan of an ink mist collecting section produces an airflow and collects ink mist generated when ink is discharged. When the carriage scans in the forward direction, an image is formed and the fan is not operated and when the carriage scans in the backward direction, the image is not formed and the fan is operated to collect the ink mist.

12 Claims, 3 Drawing Sheets

INK JET RECORDING APPARATUS

BACKGROUND OF THE INVENTION

1. Field of the Invention

The invention relates to an ink jet recording apparatus that discharges ink on a recording medium to form an image thereon and in particular, to an ink jet recording apparatus that can collect ink mist generated when ink is discharged.

2. Related Background Art

In a conventional ink jet recording apparatus, when ink is discharged on a recording medium to form an image, fine ink particles not related to forming the image and called ink mist are generated and this fine ink mist is sometimes dispersed in the recording apparatus. This dispersed ink mist adheres to various parts in the recording apparatus to have detrimental influences on the parts. For example, if the ink mist adheres to recording medium carrying means, it causes a stained recording medium, and if the ink mist adheres to an optical sensor, it causes the faulty detection of the sensor, and if the ink mist adheres to a guide member or the like of a carriage of a serial type recording apparatus, it increases resistance to driving the carriage thereby to cause a faulty operation.

A construction is disclosed in which a fan and a filter are provided in an ink jet recording apparatus in order to prevent dispersion of the ink mist, thereby collecting the generated ink mist (for example, see reference document, Japanese Patent Application Laid-Open No. H08-238784). Further, means for collecting the ink mist by an electrostatic force is also disclosed in the document. In these ink jet recording apparatuses, at the time of collecting the ink mist, it is usual to continuously operate the fan or to continuously apply voltage for generating the electrostatic force.

An ink droplet (main droplet) that is discharged from the recording means of the ink jet recording apparatus to form an image on the recording medium is sufficiently large as compared with the ink mist. Thus, even if the ink mist collecting means is continuously operated, only the ink mist is effectively collected.

However, in recent years, the ink jet recording apparatus has been increasingly required to form images of higher definition and in order to form these images of higher definition, the sizes of the main droplets for forming the image tend to become very microscopic. The ink jet recording apparatus using this very microscopic main droplets has presented a problem that when the ink mist collecting means is continuously operated, it has an influence on the fly of the main droplets and reduces the degree of accuracy when the main droplets adhere to the recording medium, thereby degrading the quality of the formed images.

Further, in the above-mentioned ink jet recording apparatus, the ink mist collecting means is continuously operated, so there is presented a problem of consuming more electric power at the time of forming the images.

SUMMARY OF THE INVENTION

Then, an object of the invention is to provide an ink jet recording apparatus in which even if main droplets for forming an image are microscopic in size, by controlling the operation of ink mist collecting means, the main droplets are not adversely affected by the ink mist collecting means, and which can perform an image forming of high definition.

Another object of the invention is to provide an ink jet recording apparatus that has ink mist collecting means and can reduce power consumption.

In order to accomplish the above-mentioned objects, an ink jet recording apparatus of the invention includes ink mist collecting means for collecting ink mist generated when recording means discharges ink in order to form an image on a recording medium, and is characterized in that the ink mist collecting means is not operated during the recording means forms the image and is operated after the recording means finishes forming the image.

In the ink jet recording apparatus of the invention, when the recording means discharges ink, the discharged ink (main droplet) immediately adheres to the recording medium to form an image but the ink mist generated when the recording means discharges the ink floats mainly in a region between the recording means and the recording medium.

Then, as described above, by adopting such a manner that the ink mist collecting means is not operated during the recording means forms the image and is operated after the recording means finishes forming the image, even in a case where the main droplets are very microscopic, the ink mist collecting means can collect only floating ink mist without having any influence on the main droplets. Moreover, by adopting such a manner that the ink mist collecting means is not operated during the recording means forming the image, it is possible to reduce the power consumption of the ink jet recording apparatus.

The ink jet recording apparatus of the invention further includes holding means for holding the recording means in such a way that the recording means can move in a forward and backward direction, and in a case where the recording means discharges ink only when the holding means moves in the forward direction, the ink mist collecting means can be operated only when the holding means moves in the backward direction. Moreover, in a case where the recording means discharges ink when the holding means moves in the forward direction and when the holding means in the backward direction, the ink mist collecting means can be operated when the holding means reverses the direction of movement from the forward direction to the backward direction and from the backward direction to the forward direction.

Further, the ink mist collecting means may have a blower for generating an airflow or may have electrostatic force generating means for generating an electrostatic force. The blower and the electrostatic force generating means may be disposed in a suction box provided with a suction nozzle extending toward a region between the recording means and the recording medium.

DETAILED DESCRIPTION OF THE PREFERRED EMBODIMENT

The preferred embodiments of the present invention will hereinafter be described with reference to the drawings.

First Embodiment

Figure 1:
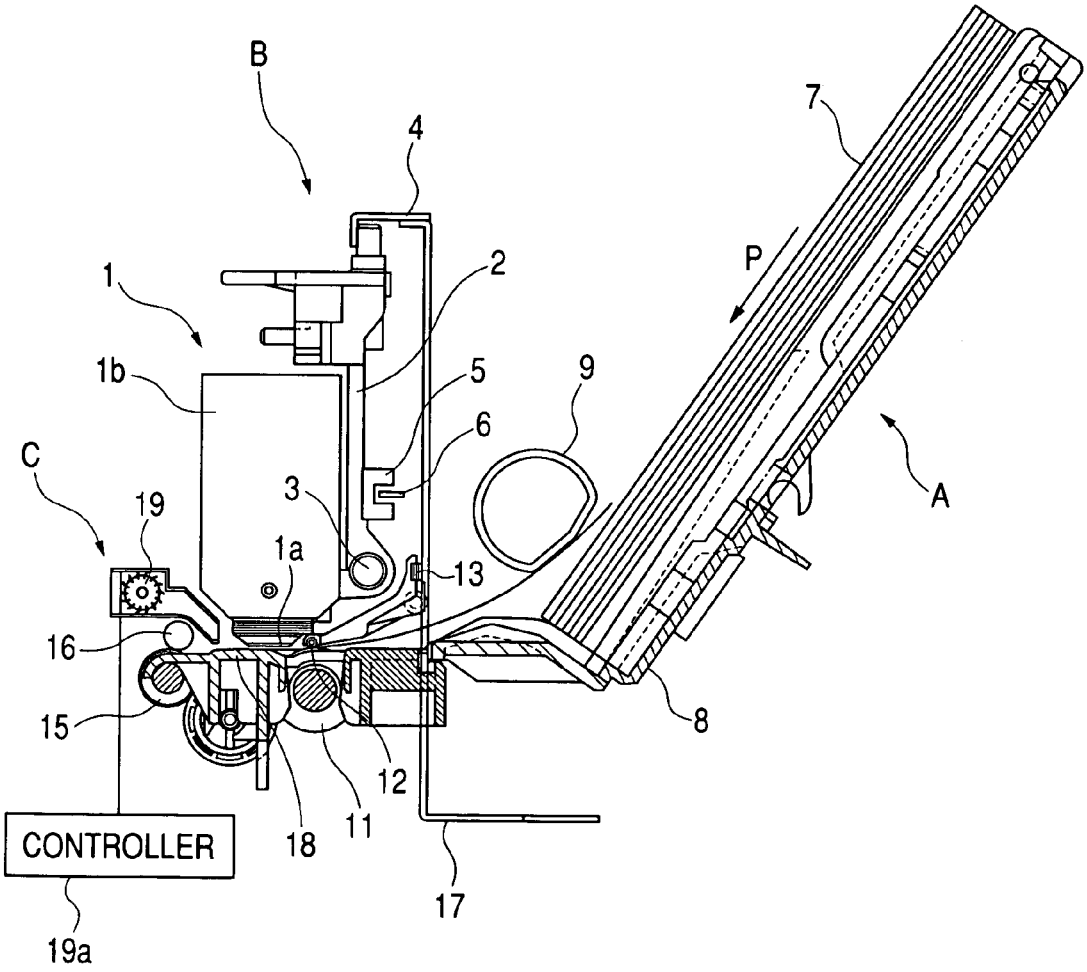
FIG. 1 is a side sectional view showing a first embodiment of an ink jet recording apparatus according to the present invention.
Figure 2:
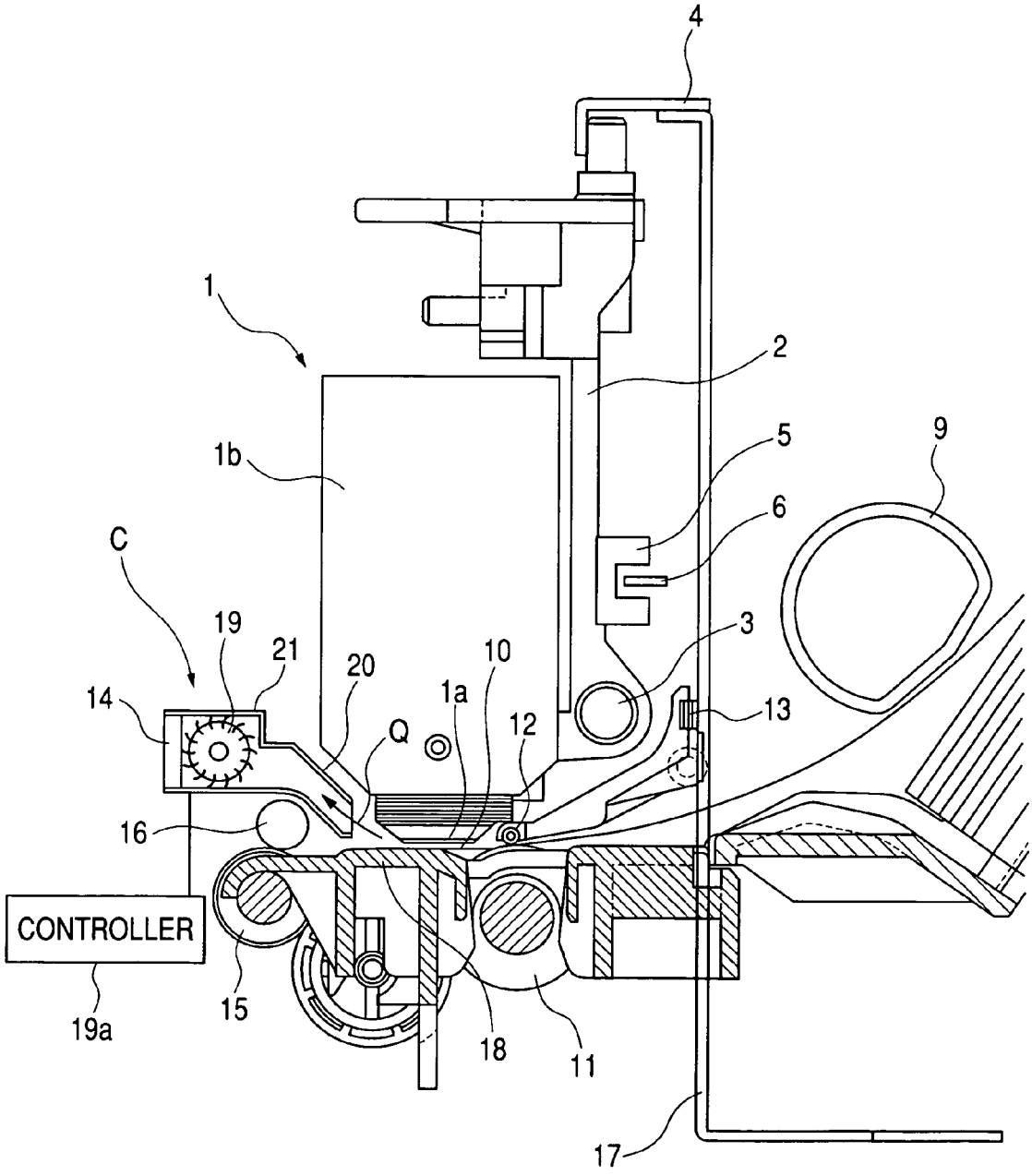
FIG. 2 is an enlarged view showing the periphery of a recording section of the embodiment in FIG. 1.

FIG. 1 is a side sectional view showing the first embodiment of an ink jet recording apparatus according to the invention. FIG. 2 is an enlarged view showing the periphery of a recording section of the embodiment in FIG. 1.

This ink jet recording apparatus has a carrying section A for carrying a recording medium such as a recording sheet, a recording operation section B for forming an image on the recording medium, and an ink mist collecting section C for collecting ink mist. Hereinafter, the respective sections will be described.

First, the recording operation section B will be described. The recording operation section B has a carriage 2 removably mounted with a recording head cartridge 1 scanning in a direction orthogonal to a direction in which the recording medium is carried. The recording head cartridge 1 has a recording head 1*a* for discharging ink and an ink tank 1*b* for storing ink supplied to the recording head 1*a*. The recording head 1*a* has a plurality of discharge ports (not shown) for discharging ink and is mounted on the carriage 2 with a discharge port surface in which the plurality of discharge ports are made facing downward. The carriage 2 is supported by a carriage shaft 3 and a guide rail 4 fixed to a printer chassis 17 to be the base of the recording operation section B of this ink jet recording apparatus and is driven by a carriage driving motor (DC motor: not shown) via a belt (timing belt), thereby scanning along the carriage shaft 3. The carriage 2 is mounted with a reading sensor 5 (for example, an optical reading sensor). The reading sensor 5 constitutes a linear encoder which reads a scale 6 (for example, optical encoder slits) fixed to the printer chassis 17 and which thereby detects the position of the carriage 2 in the width direction of the recording medium (in the direction orthogonal to the direction in which the recording medium is carried). An optical encoder or a magnetic encoder can be used as the linear encoder.

A method of discharging ink from the discharge port of the recording head 1*a* is broadly divided into a method of supplying ink with thermal energy by a heater and utilizing a change in the state of ink (for example, occurrence of bubbles) caused by the thermal energy and a method of supplying ink with mechanical energy by a piezoelectric element and thereby applying an instantaneous discharge pressure to the ink. Then, either of these two types of a recording head can be adopted in the invention.

On side of the width direction of the recording medium (direction orthogonal to the direction in which the recording medium is carried) of the printer chassis 17 (side toward the front in FIG. 1) is assumed to be a reference side for positioning the carriage 2 and the like and the other side (side toward the back in FIG. 1) is assumed to be a non-reference side. Then, on the reference side of the printer chassis 17 are arranged a recovery unit (not shown) having a sucking and recovering function for recovering the function of the recording head 1*a* and keeping the performance thereof and a wiper function for wiping the surface in which the ink discharge ports of the recording head cartridge 1 are made (hereinafter referred to as "ink discharge port surface").

Next, the carrying section A will be described. In this embodiment, an automatic sheet feeder 8 on which the recording mediums are stacked is provided on the rear side of the carriage 2. As shown in FIG. 1 and FIG. 2, a sheet feed roller 9 for feeding the uppermost sheet of stacked recording mediums to the recording operation section B, a carrier roller 11 rotated by a sheet feed driving motor (not shown), and a pinch roller 12 for pressing the recording medium onto the carrier roller 11 by a biasing spring 13 are provided in a carrying path of the recording medium from the automatic sheet feeder 8. A platen 18 is opposed to the ink discharge port surface of the recording heads 1*a* on the downstream side in the direction in which the recording medium is carried by the carrier roller 11 and the pinch roller 12, thereby constituting a recording section 10 in a region between the recording head 1*a* and the platen 18. In the recording section 10, the ink is discharged above the platen 18 from the recording heads 1*a* to perform recording on the recording medium. A sheet discharge roller 15 to be rotated and a spur roller 16 for pressing the recording medium onto the sheet discharge roller 15 are provided on the downstream side in the direction in which the recording medium is carried of the recording section 10.

Incidentally, the printer chassis 17 positions and holds the automatic sheet feeder 8, the carriage driving motor (not shown), the sheet feed driving motor, and a control device, and rotatably holds the carrier roller 11 and the sheet discharge roller 15. Next, the ink mist collecting section C will be described. The ink mist collecting section C has a fan 19 that produces an airflow thereby to suck air in the recording section 10.

Specifically, a suction box 21 having a suction nozzle 20 open to the recording section 10 is provided on the downstream side in the direction in which the recording medium is carried of the recording section 10 and the fan 19 for sucking the air from the recording section 10 and discharging it outside is provided in the suction box 21. A filter 14 for adsorbing ink mist is provided at the exit of the suction box 21. A reference numeral 19*a* denotes a controller for controlling the fan 19.

Next, the operation of this ink jet recording apparatus will be described. When the sheet feed roller 9 is rotated, the recording medium is carried along the flow of the recording medium (recording paper), as shown by arrow P in FIG. 1, to a contact point between the carrier roller 11 and the pinch roller 12. Then, when the carrier roller 11 is driven by the sheet feed driving motor (not shown), the recording medium is carried to the recording section 10 with the recording medium pinched by the carrier roller 11 and the pinch roller 12. In the recording section 10, in synchronization with the carriage 2 scanning in the width direction of the recording medium, an ink discharge mechanism mounted on the recording head 1*a* is driven, whereby ink is suitably discharged onto the recording medium by the recording head 1*a*. When the carriage 2 finishes one scanning, the recording medium is carried by a predetermined pitch (until a portion not yet to be printed is brought to a position opposite to the recording head 1*a*). Then, the carriage 2 again scans the recording medium, whereby recording of the next line is performed by the recording head 1*a*. In this manner, carrying the recording medium by the predetermined pitch repeatedly alternates with the scanning of the carriage 2 and the ink discharging by the recording head 1*a*, whereby recording of the whole area of one recording medium is performed.

A recording head cartridge 1 is moved to a position opposite to the above-mentioned recovery unit when recording is not performed and at predetermined time intervals and is subjected at this position to a predetermined recovery treatment such as a suction operation by the suction mechanism or a wiping operation by a wiping mechanism, thereby keeping good discharge characteristics. By using this position opposite to the recovery unit as a reference position, the scanning of the carriage 2 performed for the recording head cartridge 1 to perform recording and the movement of the carriage 2 performed so as to perform the recovery treatment of the recording head cartridge 1 are controlled. The scanning of the carriage 2 is performed in such a way that a position in the width direction of the recording medium of the carriage 2 is detected by using the reading sensor 5 and the scale 6 and is fed back to a controller (not shown) for controlling the carriage driving motor according to the position. A timing of driving the recording head 1*a* (timing of discharging ink) is also determined on the basis of the position data of the carriage 2 obtained by the reading sensor 5 and the scale 6 and hence the ink discharging of the recording head 1*a* is performed in synchronization with the scanning of the carriage 2.

In general, in a case where a color image of high definition and high accuracy is formed on the recording medium, in order to increase a position accuracy with which the ink is put on the recording medium, in many cases, the ink is discharged only when the carriage 2 scans from the above-mentioned reference position side to a non-reference position side (hereinafter referred to as "forward direction") and the ink is not discharged when the carriage 2 scans from the non-reference position side to the reference position side (hereinafter referred to as "backward direction"). The recording medium on which an image is formed by the recording head 1*a* in the recording section 10 is discharged outside by the sheet discharge roller 15 and the spur roller 16.

In this embodiment, when the carriage 2 scans in the forward direction, the recording head 1*a* discharges the ink to perform recording without operating the fan 19 and when the carriage 2 scans in the backward direction, the recording head 1*a* does not perform recording and the fan 19 is operated to collect ink mist. At a time when the recording head 1*a* finishes producing recording in the forward direction, most of ink mist floats in the ink jet recording apparatus, in particular, near the recording section 10, so it is-effective to operate the fan 19 and to collect the ink mist at the time. Specifically, after the recording head 1*a* finishes performing recording, the airflow produced by the fan 19 in the same direction as the direction in which the recording medium is carried, as shown by arrow Q in FIG. 2, sucks the ink mist from the suction nozzle 20 into the suction box 21. The ink mist is adsorbed by the filter 14 in the suction box 21. When the fan 19 is operated, the ink (main droplets) discharged from the recording head 1*a* already adhere to the surface of the recording medium, so even if the fan 19 is operated, the main droplets are not affected by the airflow by the fan 19.

While a case where the recording head 1*a* performs recording only when the carriage 2 scans in the forward direction has been described in this embodiment, in a case where it is allowed to perform recording with a slightly reduced degree of high definition and high accuracy, when the carriage 2 scans in the forward direction and when the carriage 2 scans in the backward direction, the recording head 1*a* discharges the ink to perform recording, where shortening a recording time can be realized. In the following, a case will be described where when the carriage 2 scans in the forward direction and when the carriage 2 scans in the backward direction, the recording head 1*a* performs recording.

In this case, when the carriage 2 scans in the forward direction, the recording head 1*a* discharges ink to perform recording without operating the fan 19, and when the carriage 2 reverses the direction of scanning from the forward direction to the backward direction, the fan 19 is operated to collect the ink mist. Thereafter, when the carriage 2 scans in the backward direction, the recording head 1*a* discharges ink to perform recording without operating the fan 19, and when the carriage 2 reverses the direction of scanning from the backward direction to the forward direction, the fan 19 is again operated to collect the ink mist. By repeating the above operations, it is possible to perform recording and collect the ink mist when the carriage scans in the forward direction and when the carriage scans in the backward direction.

While the carriage 2 scans in a first direction (in the forward direction), the recording head 1*a* discharges ink and after it finishes discharging ink, the fan 19 is turned on. Thereafter, the carriage 2 further continues scanning in the first direction and switches from the first direction to a second direction (the backward direction) at a predetermined point. After the carriage 2 starts moving in the second direction, the recording head 1*a* starts discharging ink. The fan 19 is turned off after the carriage 2 starts moving in the second direction and before the recording head 1*a* starts discharging ink.

As described above, in this embodiment, it has been possible to realize an ink jet recording apparatus which can effectively collect the ink mist by the fan 19 and prevent faulty operations of various parts in the device from being caused by the ink mist and hence perform long-life and stable image forming and have excellent reliability.

Further, it has been made sure that by adopting such a manner that the fan 19 is not operated when the recording head 1*a* discharges ink, the main droplets for forming the image are not affected by collecting the ink mist.

Still further, it has been made sure that power consumption is made smaller by intermittently operating the fan 19 than by continuously operating the fan 19 as usual.

Still further, in this embodiment, by adopting such a manner that the fan 19 is not operated when the recording head 1*a* discharges ink, the main droplets are not affected by collecting the ink mist, so it is possible to increase the output of the fan 19 and to improve collection efficiency as compared with a conventional device.

Second Embodiment

Figure 3:
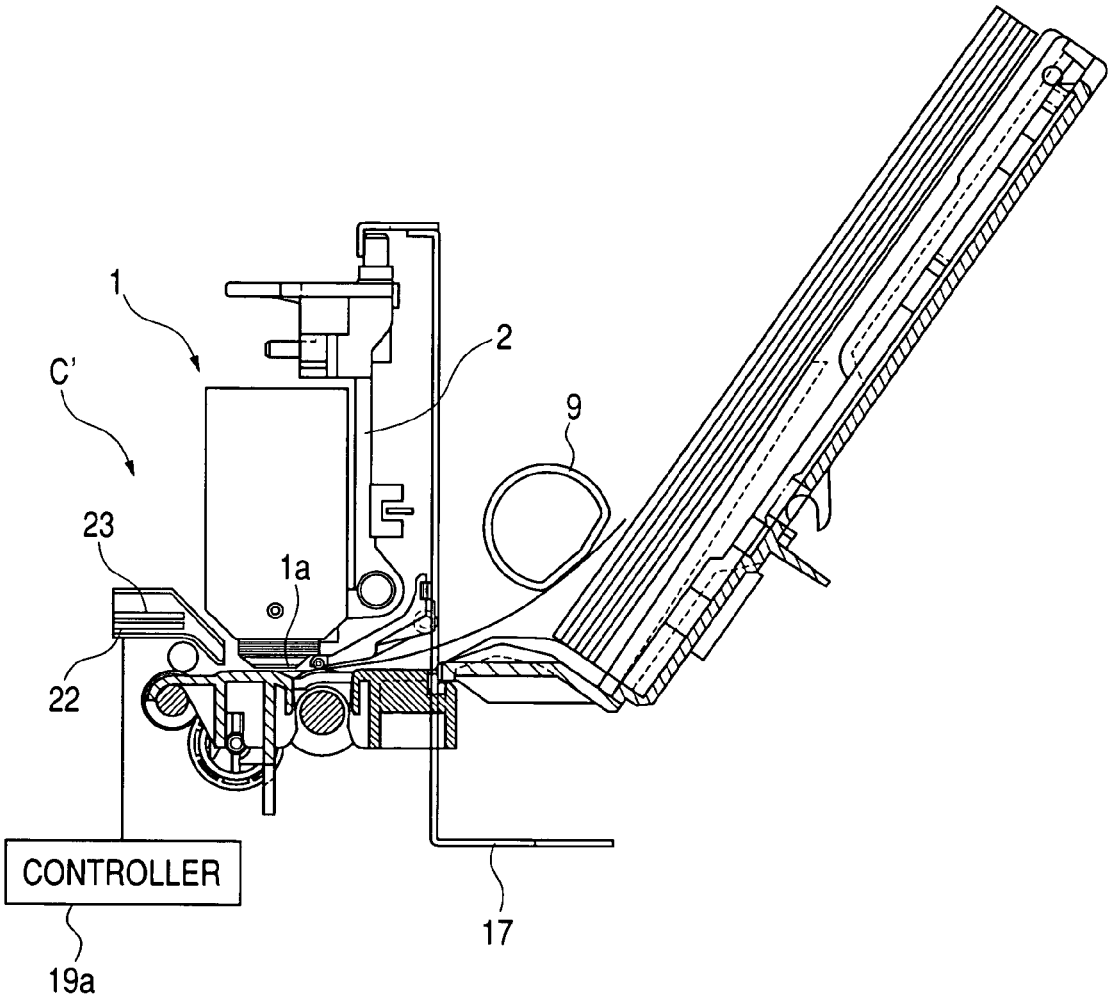
FIG. 3 is a side sectional view showing a second embodiment of an ink jet recording apparatus according to the invention.

While the airflow is utilized to collect the ink mist in the first embodiment, the same effect can be produced even by utilizing an electrostatic force. In FIG. 3 is shown a side sectional view illustrating the second embodiment of an ink jet recording apparatus according to the invention. An ink mist collecting section C' using electrodes will be described with reference to FIG. 3. A first electrode 22 and a second electrode 23 are arranged in the suction box 21 in place of the fan 19 (see FIG. 1) and voltages having polarities different from each other are applied to the first electrode 22 and the second electrode 23. A reference numeral 19*a* denotes a controller for controlling power supply to the electrodes 22, 23.

Unnecessary liquid droplets of ink mist are usually charged positively or negatively and are attracted and collected by any one of the first electrode 22 and the second electrode 23 on which voltages of different polarities are respectively applied (by the electrode having a polarity different from the polarities of the unnecessary liquid droplets). The constitution except for the ink mist collecting section C' is the same as the first embodiment and hence its description will be omitted and the same parts are denoted by the same reference numerals used in FIG. 1 and FIG. 2. Next, a timing of applying voltages to the first electrode 22 and the second electrode 23 will be described. First, in a case where recording is to be performed only when the carriage 2 scans in one direction, when the carriage 2 scans in the forward direction, the recording head 1*a* discharges ink to perform recording without applying voltages to the first electrode 22 and the second electrode 23, and when the carriage 2 scans in the backward direction, the recording head 1*a* does not perform recording but voltages having polarities different from each other are applied to the first electrode 22 and the second electrode 23 to make the first electrode 22 and the second electrode 23 attract and collect the mist ink. Next, in a case where recording is to be performed when the carriage 2 scans in the forward direction and when the carriage 2 scans in the backward direction, when the carriage 2 scans in the forward direction, the recording head 1*a* discharges ink to perform recording without applying voltages to the first electrode 22 and the second electrode 23, and when the carriage 2 reverses the direction of scanning from the forward direction to the backward direction, voltages are applied to the first electrode 22 and the second electrode 23 to collect the ink mist. Thereafter, when the carriage 2 scans in the backward direction, the recording head 1*a* discharges ink to perform recording without applying voltages to the first electrode 22 and the second electrode 23, and when the carriage 2 reverses the direction of scanning from the backward direction to the forward direction, voltages are again applied to the first electrode 22 and the second electrode 23 to collect the ink mist. By repeating the above operations, it is possible to perform recording when the carriage 2 scans in the forward direction and when the carriage 2 scans in the backward direction and to collect the ink mist.

While the carriage 2 scans in the first direction (in the forward direction), the recording head 1*a* discharges ink and after it finishes discharging ink, voltages are applied to the first electrode 22 and the second electrode 23. Thereafter, the carriage 2 continues scanning in the first direction and changes the direction of scanning to the second direction (the backward direction) at a predetermined position. After the carriage 2 starts moving in the second direction, the recording head 1*a* starts discharging ink. Applying the voltages to the first electrode 22 and the second electrode 23 is stopped after the carriage 2 starts moving in the second direction and before the recording head 1*a* starts discharging ink.

In this manner, in this embodiment, it has been possible to realize an ink jet recording apparatus that can effectively collect ink mist by the first electrode 22 and the second electrode 23 and hence prevent faulty operations of various parts in the device from being caused by the ink mist and perform long-life and stable image forming and have excellent reliability.

Further, it has been made sure that when the recording means discharges ink, ink mist is not collected by the electrostatic force without applying voltage to the first electrode and the second electrode, so the main droplets are not affected for forming the image.

Still further, it has been made sure that power consumption is made smaller by intermittently applying voltages to the electrodes than by continuously applying voltages to the electrode as usual.

Still further, it is possible to reduce noises of the ink jet recording apparatus by collecting ink mist by using the electrostatic force as compared with collecting ink mist by using the fan.

Up to this point, two typical embodiments of the invention have been described but these may be combined. It is possible to realize an ink jet recording apparatus that can effectively collect ink mist by using both of the fan and the electrodes and hence prevent faulty operations of various parts in the device from being caused by the ink mist and perform long-life and stable image forming and has excellent reliability. Further, it has been made sure that when the recording means discharged ink, ink mist is not collected by the airflow and the electrostatic force without operating the fan and applying voltage to the first electrode and the second electrode, so the main droplets are not affected for forming the image.

Each of the ink mist collecting sections C and C' of the above embodiments is arranged near the recording section 10 and has a structure of collecting ink mist floating near the recording section 10. However, the ink mist collecting section is not necessarily arranged around the recording section 10 if it is arranged in the ink jet recording apparatus and collects ink mist in the ink jet recording apparatus. Specifically, ink mist is generated in the recording section 10 and then floats in the ink jet recording apparatus. For this reason, the ink mist collecting section is not necessarily arranged near the recording section 10 but may be arranged in the ink jet recording apparatus and collect ink mist floating in the ink jet recording apparatus.

As described above, according to the invention, by adopting such a manner that the ink mist collecting means is not operated during the recording means forms the image and is operated after the recording means finishes forming the image, it is possible to collect only ink mist with reliability. As a result, it is possible to provide an ink jet recording apparatus that resists its faulty operation being caused by adherence of ink mist and hence can perform long-life and stable image forming and has excellent reliability. Further, even if main droplets are very microscopic, they are never affected, so the invention can produce an excellent effect particularly in the ink jet recording apparatus that discharges very microscopic ink droplets in order to form an image of high definition. Still further, according to the invention, the ink mist collecting means is operated in a minimum amount of time, so it is possible to reduce the power consumption of the ink jet recording apparatus.

What is claimed is:

1. An ink jet recording apparatus comprising ink mist collecting means for collecting ink mist generated when recording means discharges ink in order to form an image on a recording medium, wherein the recording means alternates between a state where it continuously discharges the ink and a state where it does not discharge the ink, and wherein the ink mist collecting means collects ink mist when the recording means is in the state where it does not discharge the ink.

2. The ink jet recording apparatus according to claim 1, further comprising holding means for holding the recording means in such a way that the recording means is movable in a forward direction and in a backward direction, wherein the recording means discharges ink only when the holding means moves in the forward direction, and wherein the ink mist collecting means is operated only when the holding means moves in the backward direction.

3. The ink jet recording apparatus according to claim 2, wherein the ink mist collecting means has a blower for generating an airflow.

4. The ink jet recording apparatus according to claim 2, wherein the ink mist collecting means has electrostatic force generating means for generating an electrostatic force.

5. The ink jet recording apparatus according to claim 1, further comprising holding means for holding the recording means in such a way that the recording means is movable in a forward direction and in a backward direction, wherein the recording means discharges ink when the holding means moves in the forward direction and when the holding means moves in the backward direction, and wherein the ink mist collecting means is operated when the holding means reverses the direction of movement from the forward direction to the backward direction and from the backward direction to the forward direction.

6. The ink jet recording apparatus according to claim 5, wherein the ink mist collecting means has a blower for generating an airflow.

7. The ink jet recording apparatus according to claim 5, wherein the ink mist collecting means has electrostatic force generating means for generating an electrostatic force.

8. The ink jet recording apparatus according to claim 1, wherein the ink mist collecting means has a blower for generating an airflow.

9. The ink jet recording apparatus according to claim 8, wherein the ink mist collecting means has a suction box provided with a suction nozzle extending toward a region between the recording means and the recording medium, and wherein the blower is disposed in the suction box and is operated so as to suck air in the region between the recording means and the recording medium into the suction box.

10. An ink jet recording apparatus comprising ink mist collecting means for collecting ink mist generated when recording means discharges ink in order to form an image on a recording medium, wherein the ink mist collecting means is not operated during the recording means forms the image and is operated after the recording means finishes forming the image, wherein the ink mist collecting means has electrostatic force generating means for generating an electrostatic force, and wherein the ink mist collecting means has a suction box provided with a suction nozzle extending toward a region between the recording means and the recording medium, and wherein the electrostatic force generating means is disposed in the suction box.

11. An ink jet recording apparatus comprising:

holding means for holding recording means that discharges ink to record an image on a recording medium;

ink mist collecting means that collects ink mist generated when the recording means discharges the ink; and a controller that does not operate the ink mist collecting means when the recording means discharges the ink and operates the ink mist collecting means when the recording means does not discharge the ink, wherein the recording means alternates between a state where it continuously discharges the ink and a state where it does not discharge the ink, and wherein the controller operates the ink mist collecting means when the recording means is in the state where it does not discharge the ink.

12. The ink jet recording apparatus according to claim 11, wherein the holding means holds the recording means in such a way that the recording means is movable along the surface of the recording medium, and wherein the recording means discharges the ink while it is moving.

* * * * *